US009044771B2

(12) United States Patent
Kuwahara et al.

(10) Patent No.: US 9,044,771 B2
(45) Date of Patent: Jun. 2, 2015

(54) PUMP

(75) Inventors: Katsuhito Kuwahara, Tokyo (JP); Hiroyuki Nakamura, Tokyo (JP); Toru Toma, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 13/520,279

(22) PCT Filed: Jan. 17, 2011

(86) PCT No.: PCT/JP2011/000207
§ 371 (c)(1),
(2), (4) Date: Jul. 24, 2012

(87) PCT Pub. No.: WO2011/093027
PCT Pub. Date: Aug. 4, 2011

(65) Prior Publication Data

US 2012/0325862 A1 Dec. 27, 2012

(30) Foreign Application Priority Data

Jan. 28, 2010 (JP) ..... 2010-017338

(51) Int. Cl.
*G01F 11/00* (2006.01)
*B05B 11/00* (2006.01)

(52) U.S. Cl.
CPC ..... *B05B 11/3053* (2013.01); *B05B 11/3023* (2013.01); *B05B 11/3097* (2013.01)

(58) Field of Classification Search
USPC ..... 222/321.9, 375, 321.3, 571, 321.7, 222/321.2; 239/337
See application file for complete search history.

(56) References Cited

U.S. PATENT DOCUMENTS 4,144,987 A 3/1979 Kishi
5,549,223 A * 8/1996 Hori ..... 222/153.13
6,045,008 A * 4/2000 Gonzalez Fernandez et al. ..... 222/153.13
7,048,155 B2 * 5/2006 Kuwahara et al. ..... 222/321.9

(Continued)

FOREIGN PATENT DOCUMENTS

CN 1596154 A 3/2005
CN 201579158 U * 9/2010 ..... 222/321.3

(Continued)

OTHER PUBLICATIONS

English translation of CN201579158 from Espacenet.*

(Continued)

*Primary Examiner* — Kevin P Shaver
*Assistant Examiner* — Michael J Melaragno
(74) *Attorney, Agent, or Firm* — Oliff PLC

(57) ABSTRACT

An improved pump is provided that is capable of achieving excellent back suction function by using a depression head, without compromising the ease of depression operations of the head due to the additional function. The pump includes a depression head and an annular piston. The depression head is urged upward and is relatively displaceable with respect to the stem. When depressed, a lever member of the depression head operates to open a discharge opening. An annular piston opens a discharge valve, in an uppermost displacement position and closes the discharge valve in a lowermost displacement position. Back suction is caused due to a negative pressure state occurring in the stem until the discharge valve seat is closed by the annular piston during upward displacement of the stem.

8 Claims, 4 Drawing Sheets

(56) References Cited

U.S. PATENT DOCUMENTS

| | | | | |
|---|---|---|---|---|
| 8,439,234 | B2 * | 5/2013 | Chen | 222/321.3 |
| 8,584,908 | B2 * | 11/2013 | Kakuta | 222/380 |
| 2010/0176158 | A1 * | 7/2010 | Carta | 222/321.9 |
| 2011/0121037 | A1 * | 5/2011 | Kakuta | 222/320 |
| 2012/0080454 | A1 * | 4/2012 | Wang | 222/321.2 |

FOREIGN PATENT DOCUMENTS

| | | | | |
|---|---|---|---|---|
| JP | A-50-74807 | | 6/1975 | |
| JP | 06074147 | A * | 3/1994 | F04B 9/14 |
| JP | A-6-74147 | | 3/1994 | |
| JP | 07328496 | A * | 12/1995 | B05B 11/00 |
| JP | A-7-328496 | | 12/1995 | |
| JP | A-2004-834 | | 1/2004 | |
| WO | WO 2005/105597 | A1 | 11/2005 | |
| WO | WO 2007/024387 | A2 | 3/2007 | |

OTHER PUBLICATIONS

Extended European Search Report issued in European Patent Application No. 11736744.1 on Jul. 10, 2013.
International Preliminary Report on Patentability issued in International Application No. PCT/JP2011/000207 dated Sep. 18, 2012.
International Search Report issued in International Patent Application No. PCT/JP2011/000207 dated Apr. 12, 2011.
Mar. 25, 2014 Office Action issued in Japanese Patent Application No. 2011-551743 (with English translation).
Jun. 4, 2014 Office Action issued in Chinese Patent Application No. 201180007259.3 (with translation).
Office Action dated Aug. 18, 2014 in Korean Patent Application No. 10-2012-7018981 (with translation).
May 9, 2014 Office Action issued in Australian Patent Application No. 2011210409.
Nov. 6, 2014 Office Action issued in Canadian Patent Application No. 2,786,087.

* cited by examiner (a)

(b)

PUMP

TECHNICAL FIELD

The present invention relates to a pump, and more particularly to a pump that has a back suction mechanism that is easy to depress and capable of favorable shut-off of fluid leakage.

RELATED ART

The present inventors have proposed a depression head for a pump that is easy to depress and also capable of favorable shut-off of fluid leakage (e.g. refer to JP-A-2004-000834).

The depression head for a pump described in JP-A-2004-000834 is adapted to be mounted to a pump in which an upwardly urged and depressible stem extends vertically and is characterized by comprising; a mounting tubular member having a mounting tube suspended downward from a bottom surface of a top plate to be fitted onto an upper edge of the stem, and a sliding tube communicating with an inside of the stem and standing upward from the top plate; a body that is depressible with respect to the mounting tubular member, the body having a cylinder slidably fitted to an outer circumference of the sliding tube and a valve chamber above the cylinder, the valve chamber provided with an dispensing opening at a tip thereof; a valve member that is slidably fitted at a rear portion of a periphery thereof to an inner periphery of the valve chamber and is configured to form a passage leading from a communication port, which is in communication with the cylinder, to the discharging opening while closing the discharging opening when urged forward; and a lever member that is connected at un upper end thereof to a rear end of the valve member and abutted at a lower end thereof against an upper surface of the top plate and is configured to swingably pivot so as to pull the valve member rearward when the body is depressed with respect to the mounting tubular member, wherein a resistive force against the depression of the body with respect to the stem is smaller than a resistive force against the depression of the stem itself.

SUMMARY OF INVENTION

As mentioned above, the pump using the depression head has advantageous characteristics that the head can be easily depressed with a little force and that the favorable shut-off of fluid leakage is obtained.

The present invention proposes an improved pump using such a depression head to take advantage of the aforementioned characteristics of the depression head, and also capable of achieving excellent back suction function in addition to the aforementioned characteristics without compromising the ease of depression operations of the head due to the additional function.

The pump according to the present invention is adapted to be vertically suspended in and mounted to a container body for discharge of fluid stored in the container body. The pump includes a cylinder having a suction valve at a bottom thereof and an actuator member urged upward and also depressible with respect to the cylinder. The actuator member includes a stem having a bottomed tubular shape urged upward and also depressible, a depression head urged upward and relatively displaceable upward and downward with respect to the stem, and an annular piston provided around an outer circumference of the stem for relative upward and downward displacement with respect to the stem. The depression head has: a valve chamber provided with a discharge opening at a tip thereof; an opening-closing valve member disposed in the valve chamber in a manner such that the opening-closing valve member is urged toward the discharge opening; and a lever member connected at an upper end thereof to a rear end of the opening-closing valve member, and is configured such that, when depressed, the lever member of the depression head operates to open the discharge opening by displacing the opening-closing valve member and that a resistive force against the depression of the depression head with respect to the stem is smaller than a resistive force against the depression of the stem itself. The annular piston has a lower end forming a discharge valve in cooperation with a discharge valve seat protruding from the outer circumference of the stem and is configured to be pressed against the valve seat to close the discharge valve at a lowermost displacement position and displaced off the discharge valve seat to open the discharge valve at an uppermost displacement position.

In a preferred embodiment, the annular piston has an H-shaped cross section formed by joining an outer peripheral tubular portion and an inner peripheral tubular portion with a joining portion, the outer peripheral tubular portion being fitted at upper and lower edges thereof to an inner periphery of the cylinder for a leak tight sliding contact with the cylinder and the inner peripheral tubular portion being fitted at an upper edge thereof to an inner periphery of a sealing tubular portion for a leak tight sliding contact with the sealing tubular portion, the sealing tubular portion being suspended around the outer circumference of the stem to form a double tube structure, and the discharge valve is formed by an lower edge of the inner peripheral tubular portion in cooperation with the discharge valve seat, and the annular piston is relatively displaced upward and downward with respect to the stem from a position where the lower edge of the inner peripheral tubular portion is pressed against the discharge valve seat to a position where an upper end surface of the connecting part is abutted against a lower end surface of the sealing tubular portion.

In the above embodiment, a stroke width from the position where the lower edge of the inner peripheral tubular portion of the annular piston is pressed against the discharge valve seat to the uppermost displacement position is preferably selected so that back suction is caused due to a negative pressure state in the stem occurring until the discharge valve seat is closed by the annular piston during upward displacement of the stem, and more preferably, greater than $1.5\times10^{-3}$ m.

Furthermore, the suction valve preferably comprises a pressure-contact valve in which a pressure-contact valve body is constantly pressed against a suction valve seat. Moreover, the pump further comprises: a first resilient member urging the stem; and a second resilient member urging the opening-closing valve member, wherein resilience of the second resilient member is selected to be smaller than resilience of the first resilient member.

In the present invention, when the actuation member is displaced upward after being depressed, the opening-closing valve member of the depression head remains opened, and therefore a favorable back suction effect is created due to the negative pressure state occurring in the stem until the discharge valve seat is closed by the annular piston. The pump according to the present invention is also characterized in that the actuation member can be depressed with a little force. Moreover, even compared with a possible case where an opening is created at a bottom of the stem and a poppet valve body or like is inserted through the opening such that the poppet valve body is displaceable upward and downward for the sake of buck suction effect, the pump according to the present invention is easier to depress because excessive friction force is prevented from being applied to the actuation member.

With the structure that the annular piston has an H-shaped cross section formed by joining an outer peripheral tubular portion and an inner peripheral tubular portion with a joining portion, the outer peripheral tubular portion being fitted at upper and lower edges thereof to an inner periphery of the cylinder for a leak tight sliding contact with the cylinder and the inner peripheral tubular portion being fitted at an upper edge thereof to an inner periphery of a sealing tubular portion for a leak tight sliding contact with the sealing tubular portion, the sealing tubular portion being suspended around the outer circumference of the stem to form a double tube structure, and that the discharge valve is formed by an lower edge of the inner peripheral tubular portion in cooperation with the discharge valve seat, and the annular piston is relatively displaced upward and downward with respect to the stem from a position where the lower edge of the inner peripheral tubular portion is pressed against the discharge valve seat to a position where an upper end surface of the connecting part is abutted against a lower end surface of the sealing tubular portion, clear differences exist between inside and outside of the annular piston in terms of friction when the stem is displaced upward from the lowermost displacement position because of the presence of the outer peripheral tubular portion sliding at its upper and lower edges and the inner peripheral tubular portion sliding at its upper end, and unfavorable situations where the annular piston is displaced upward together with the stem or relatively displaced downward after the displacement of stem are prevented. When the stem is displaced downward from the uppermost displacement position also, unfavorable situations where the annular piston is displaced downward together with the stem or relatively displaced upward after the displacement of the stem are prevented, and accordingly, smooth operations are made possible.

With the structure that a stroke width from the position where the lower edge of the inner peripheral tubular portion of the annular piston is pressed against the discharge valve seat to the uppermost displacement position is greater than $1.5\times10^{-3}$ m, a sufficiently large negative pressure is guaranteed in the stem regardless of size of a diameter of the sealing tubular portion, which results in a more reliable back suction effect. Note that the above stroke width is applied to a handheld type product and a household product that generally utilizes the above type of pump.

With the structure that the suction valve comprises a pressure-contact valve in which a pressure-contact valve body is constantly pressed against a suction valve seat, it is assured that the suction valve is closed until the annular piston is initially closed when the stem is displaced upward after being displaced downward, which results in an even more efficient back suction effect.

DESCRIPTION OF EMBODIMENTS

The present invention is described in detail below with reference to the drawings.

Figure 1:
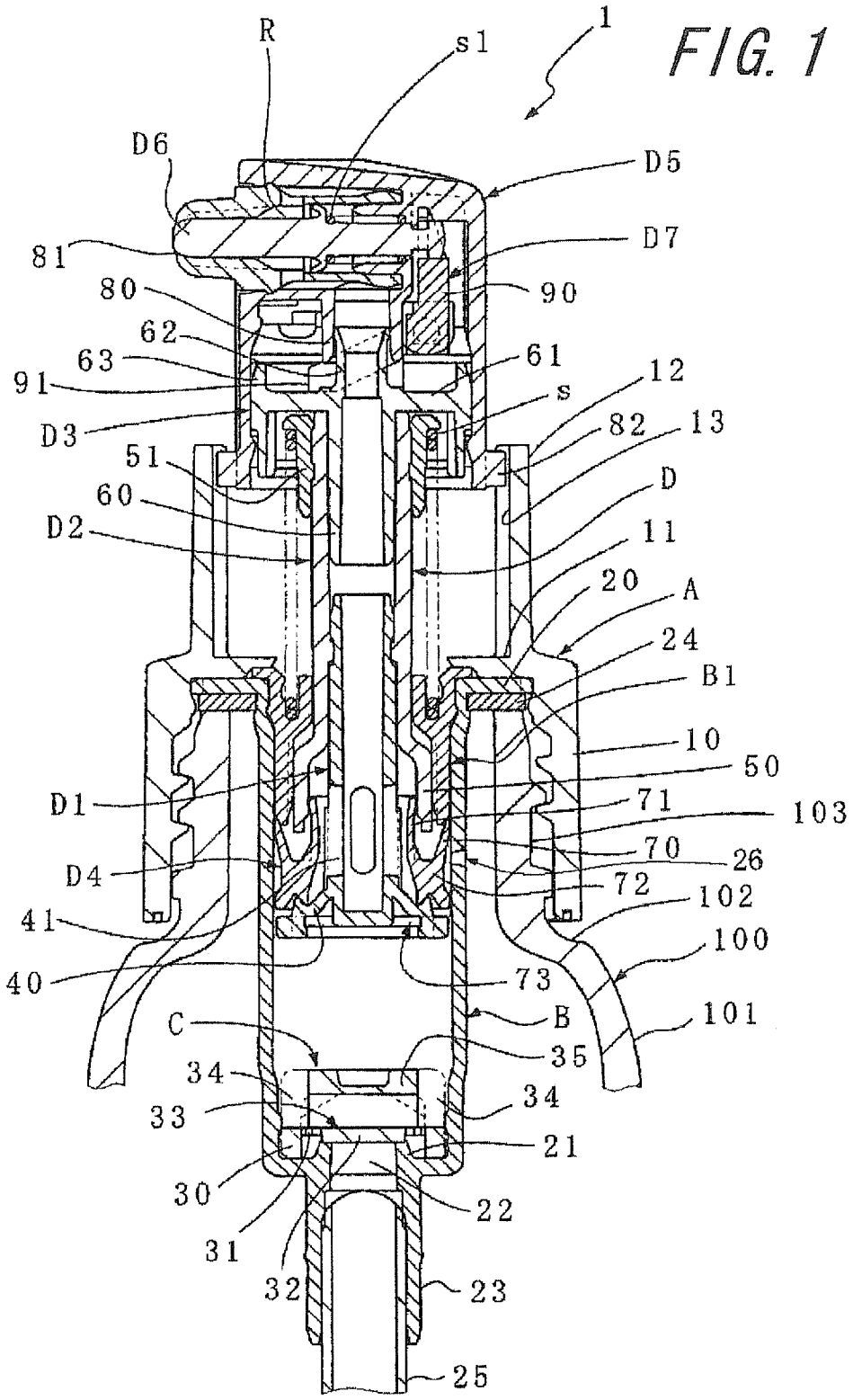
FIG. 1 is a longitudinal section view of a pump according to Embodiment 1.

FIG. 1 shows one example of a pump 1 mounted to a container body 100. The container body 100 has a trunk portion 101, a shoulder portion 102, and a mouth-and-neck portion 103 standing from the trunk 101 via the shoulder portion 102.

The pump 1 includes a mounting cap A, a cylinder B, a suction valve member C, and an actuation member D.

The mounting cap A includes a screw tube 10 screwed around an outer periphery of the mouth-and-neck portion 103, a top plate 11, and a guiding tube 12. The screw tube 10 is suspended downward from a back surface of an outer peripheral portion of the top plate 11, and the guiding tube 12 extends upward from an upper surface of the top plate 11. An inner surface of the guiding tube 12 is provided with a pair of guiding recesses 13 extending longitudinally.

The cylinder B has a cylindrical shape provided with openings at top and bottom and fitted onto the back surface of the top plate 11, with a flange 20, which extends outward from an exterior upper end of the cylinder B, fitted onto a back surface of the top plate 11. The upper end of the cylinder B is also fitted with a latch member B1 for latching a lower end of a coil spring s. Furthermore, the opening at the bottom is formed as a suction valve hole 22 surroundingly defined by a cylindrical suction valve seat 21. From the bottom surface, a pipe fitting tube 23 extends in communication with the suction valve hole 22. The cylinder B is inserted into the container body 100 in a vertically suspended manner to be held and fixed between the mouth-and-neck portion 103 and the top plate 11 of the mounting cap, with the flange 20 mounted on the mouth-and-neck portion 103 via a packing 24. Moreover, an upper end of a pipe 25 is fitted into the pipe fitting tube 23, and a lower end of the pipe 25 is vertically suspended toward an inner bottom of the container body 100. The outer circumference of the cylinder is also pierced with a negative pressure release hole 26.

The suction valve member C includes a fitting tube portion 30 securely fixed to an inner bottom of the cylinder B and a pressure-contact valve body 32 extending from an inner circumference of the fitting tube portion 30 via a plurality of resilient pieces 31 provided circumferentially. The pressure-contact valve body 32 is pressed against the suction valve seat 21 at the bottom of the cylinder B to form a suction valve 33. The suction valve 33 is configured to be opened when an interior of the cylinder B assumes negative pressure and to return to an original closed state by resilience of the resilient pieces 31 when the negative pressure is released. Furthermore, a supporting platform plate 35 bridges between upper ends of a pair of supporting plates 34 extending upward from either side of the fitting tube part 30. Note that the supporting platform plate 35 may be configured to define a lowermost displacement position of the stem.

The actuator member D includes a stem D1, a connecting tubular member D2, a mounting tubular member D3, an annular piston D4, and a depression head D5.

The stem D1 has a bottomed tubular shape having an opening at an upper end and is urged upward by the coil spring s which is engaged at its lower end by the latch member B1. Furthermore, a discharge valve seat 40 is provided to project from an end portion of a periphery of the stem D1, and tubular wall portion right above the discharge valve seat 40 is pierced with a plurality of discharge valve holes 41. An upper portion of the stem D1 also connects to the mounting tubular member D3 via the connecting tubular member D2. A lower portion of the connecting tubular member D2 is fitted over the upper portion of the stem D1, and a lower end of the fitted portion is formed as a large-diameter sealing tubular portion 50 for creation of annular space in which a part of the annular piston D4 is fitted between the stem D1 and the connecting tubular member D2. In an upper end of the periphery of the connecting tubular member D2, a latch member 51 is fitted for engagement with an upper portion of the coil spring s.

The mounting tubular member D3 includes a mounting tube 60 suspended downward from a back surface of a top plate portion 61 to be fitted onto an upper inner part of the connecting tubular member D2, and from middle of the top plate portion 61, a slide tube 62 stands upward in communication with an interior of the mounting tube 60. Furthermore, a guiding tubular portion 63 is circumferentially provided around, over, and under a periphery of the top plate portion 61.

The annular piston D4 has an H-shaped cross section formed by joining an outer peripheral tubular portion 70 and an inner peripheral tubular portion 71 with a joining portion 72, and the outer peripheral tubular portion 70 is fitted at its upper and lower edges to an inner periphery of the cylinder B for a leak tight sliding contact with the cylinder B and the inner peripheral tubular portion 71 is fitted at its upper edge to an inner periphery of the sealing tubular portion 50 for a leak tight sliding contact with the sealing tubular portion 50. The annular piston D4 is also configured to be relatively displaceable upward and downward with respect to the stem D1 from a position where a lower edge of the inner peripheral tubular portion 71 is in sealed contact with the discharge valve seat 40 to a position where an upper end surface the joining portion 72 abuts against a lower end surface of the sealing tubular portion 50, thus forming a discharge valve 73 in cooperation with the discharge valve seat 40.

Figure 2:
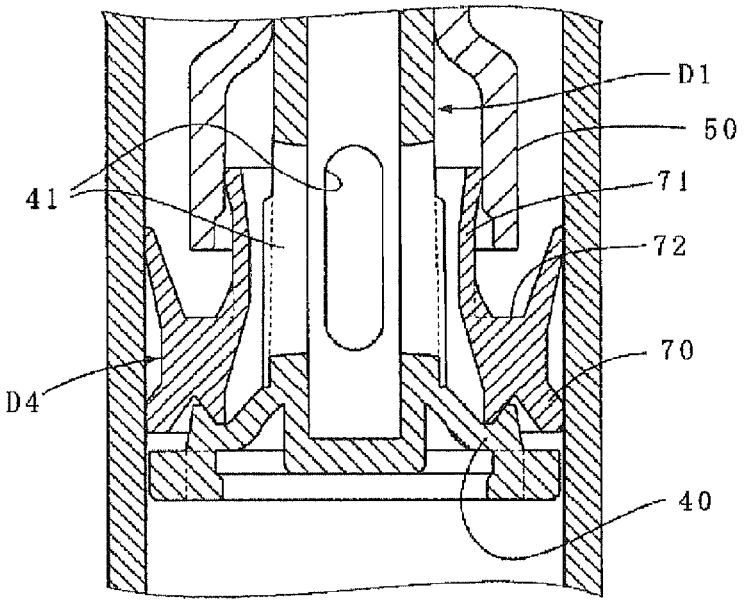
FIG. 2 is an enlarged view of main parts of the pump shown in FIG. 1 for illustrating effects of the pump.
Figure 2:
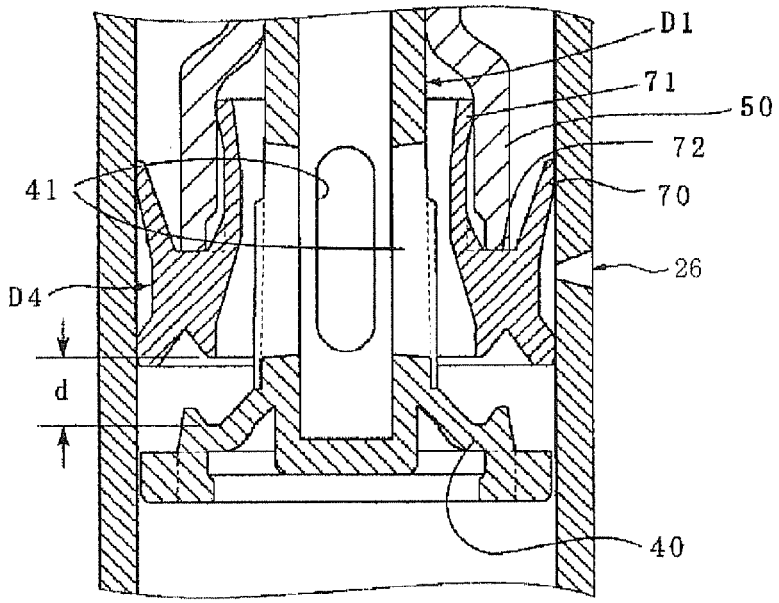

In the present example, a stroke width between the position where the lower edge of the inner peripheral tubular portion 71 of the annular piston D4 is pressed against the discharge valve seat 40 as shown in FIG. 2A and the uppermost displacement position (d) as shown in FIG. 2B may be basically determined appropriately so that desirable fluid flow is achieved, and is preferably from around $0.5\times10^{-3}$ m to $1.0\times10^{-3}$ m, for example. Note that the stroke width here is applied to a handheld type product and a household product that generally utilizes the above type of pump having a sealing tubular portion 50 with an inner diameter of approximately $2\times10^{-3}$ m to $15\times10^{-3}$ m. Although the stroke width in the above range is sufficient to achieve the back suction effect, a more reliable and optimal back suction effect can be obtained by increasing the stroke width. When increased, the stroke width is preferably $1.5\times10^{-3}$ m or more. By making the stroke width greater than the above value, a significant effect of the stroke width is obtained even when the diameter of the stem D1 or the sealing tubular portion 50 is more or less varied due to size of the pump within the aforementioned targeted range.

The depression head D5 is connected to the stem D1 via the mounting tubular member D3 such that the depression head D5 can be depressed with respect to the mounting tubular member D3. The depression head D5 has a cylindrical portion 80 fitted to an outer circumference of the slide tube 62 in a manner such that the cylindrical portion 80 is slidable downward, and a valve chamber R above the cylindrical portion 80, the valve chamber R provided with a discharge opening 81 at its tip, and thus depressible with respect to the tubular member D3.

Inside the valve chamber R, an opening-closing valve member D6 urged toward the discharge opening 81 is also provided. The opening-closing valve member D6 has an outer periphery (of an inverted skirt-like shape) slidably fitted to an inner circumference of the valve chamber R and closes the discharge opening 81 when urged forward. The valve chamber R is also connected in its interior into the cylindrical portion 80 via a communication port, thus forming a fluid passage leading from the cylindrical portion 80 to the discharge opening 81 via the communication port. As the means for urging the opening-closing valve member D6 forward, second coil spring s/is interposed both in front of a rear wall of the valve chamber R and in a branch area of the inverted skirt-like shape. The opening-closing valve member D6 is also configured to project at its rear end from a window opening provided in the rear wall of the valve chamber R, and the projecting portion is provided with an annular recess in which a lever member is fitted.

The lever member D7 is provided inside the depression head D5. The lever member D7 has an upper end connected to the rear end of the opening-closing valve member D6 and a lower end abutted against an upper surface of the top plate portion 61 and is swingably pivoted to pull the opening-closing valve member D6 rearward when the depression head D5 is depressed with respect to the mounting tubular member D3.

The lever member D7 shown in the exemplary figure has a vertical plate 90, whose upper end is connected to the rear end of the opening-closing valve member D6, and a double-branched slant plate 91 extending forward and downward from a lower end of the vertical plate portion 90. The lower ends of the double-branched slant plate 91 are in abutment contact with the upper surface of the top plate portion 61 located on either side of the slide tube. The vertical plate 90 is provided with a notch in middle of its upper end portion, and the connection between the lever member D7 and the opening-closing valve member D6 is achieved by engaging the aforementioned annular recess of the opening-closing valve member D6 with the notch.

Furthermore, the lever member D7 has a bent portion from which a pivot axis protrudes to both sides, and both sides of the pivot axis are rotatably fit to respective bearings. With the above structures, the upper part of the vertical plate 90 defining the connection area is constantly urged forward due to the opening-closing valve member D6 urged forward by the second coil spring s1, and when the depression head D5 is depressed, the top plate portion 61 of the mounting tubular member D3 lifts the slant plate 91 to cause the lever member D7 to be rotated. Upon rotation, the lever member D7 pulls the opening-closing valve member D6 rearward against the forward biasing force of the second coil spring s1.

In the above depression head D5, the resistive force against the depression of the depression head D5 with respect to the stem D1 is made smaller than the resistive force against the depression of the stem itself. In order to achieve the above feature, basically it is only necessary to select resilience of a resilient member used for urging the opening-closing valve member D6 forward, i.e. the second coil spring s/, to be smaller than resilience of a resilient member used for urging the stem of the pump upward, i.e. coil spring s, in consideration of other elements, such as friction between the slide tube and the cylinder or friction occurring during swing movements of the lever member.

The depression head D5 also includes at its lower outer periphery a pair of protrusions 82 fitted into a corresponding one of the guiding recesses 13 provided in the guiding tube 12 so that each protrusion 82 can be displaced upward and downward.

According to the pump 1 structured as described above, when the depression head D5 is depressed from the state shown in FIG. 1, the stem D1 initially remains undepressed, and the depression head D5 is displaced downward with respect to the mounting tubular member D3. Consequently, the lower end of the lever member D7 is lifted by the upper surface of the top plate portion 61 of the mounting tubular member D3 and rotated about the pivot axis until the upper end of the lever member D7 pivotally swings rearward to cause the opening-closing valve member D6 to be displaced rearward against the resilience of the second coil spring s1, which causes the discharge opening 81 to open.

Subsequently, the stem D1 is displaced downward, and accordingly, the annular piston D4 is displaced upward relative to the stem D1 to open the discharge valve 73. Then, pressurized fluid contained in the cylinder B starts to flow into the stem D1 via the discharge valve hole 41, is introduced into the slide tube 62, and subsequently passes through the cylindrical portion 80 and the valve chamber R to be discharged through the discharge opening 81.

Next, when the depression head D5 is released from the depression force, the depression head D5 is initially displaced upward by the upward biasing force of the stem D1. However, in this circumstance, the stem D1 starts to be displaced upward before the depression means, such as a user's hand, is completely taken off the top of the depression head D5, while the discharge opening 81 still remains opened. At the same time, the annular piston D4 is displaced downward relative to the stem D1, whereby the discharge valve 73 is closed. In this circumstance, since the stroke width of the annular piston D4 is made large, the interiors of the stem D1 and the valve chamber R assume a sufficient negative pressure state to achieve the back suction function until the annular piston D4 is closed, and therefore, the favorable back suction function is achieved. After that, the finger can be lifted off the top at the user's discretion, and the opening-closing valve member D6 is displaced forward by the resilience of the second coil spring s1 to close the discharge opening 81. In conjunction with the movement of the opening-closing valve member D6, the lever member D7 pivots to lift the depression head D5 upward with respect to the mounting tubular member D3, bringing the mounting tubular member D3 and the depression head D5 back into the original state.

In response to the upward movement of the actuator member D, the interior of the cylinder B transitions to the negative pressure state, and accordingly, the suction valve 33 is opened so that the fluid contained in the container body 100 is introduced into the cylinder B through the pipe 25.

Figure 3:
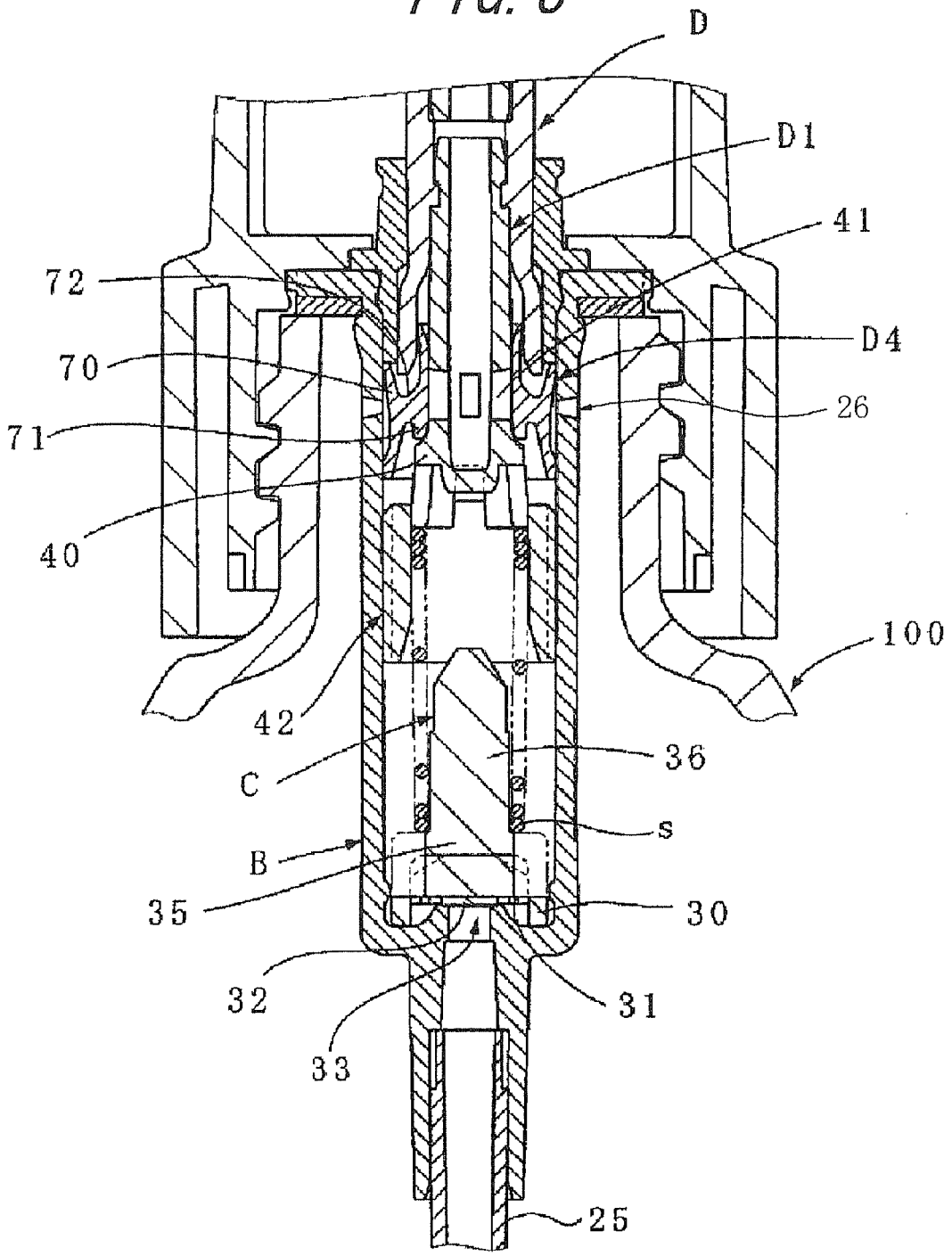
FIG. 3 is an enlarged section view of main parts of a pump according to Embodiment 2.

FIG. 3 shows a pump according to Embodiment 2. This pump is modified in comparison with the example of FIG. 1 in that the coil spring s is interposed between the suction valve member C and the stem D1. In the case of Embodiment 2, the suction valve member C is modified in comparison with the example of FIG. 1 in that a bar 36 is provided to stand from an upper surface of the supporting platform plate 35 to be engaged with the lower end of the coil spring s. The upper portion of the coil spring s is latched by a latch 42 protruding from the bottom surface of the stem D1 and having a tubular portion supported by a plurality of clips. The pump according to Embodiment 2 has substantially the same structures as in the example of FIG. 1, and a description of such structures is omitted.

Figure 4:
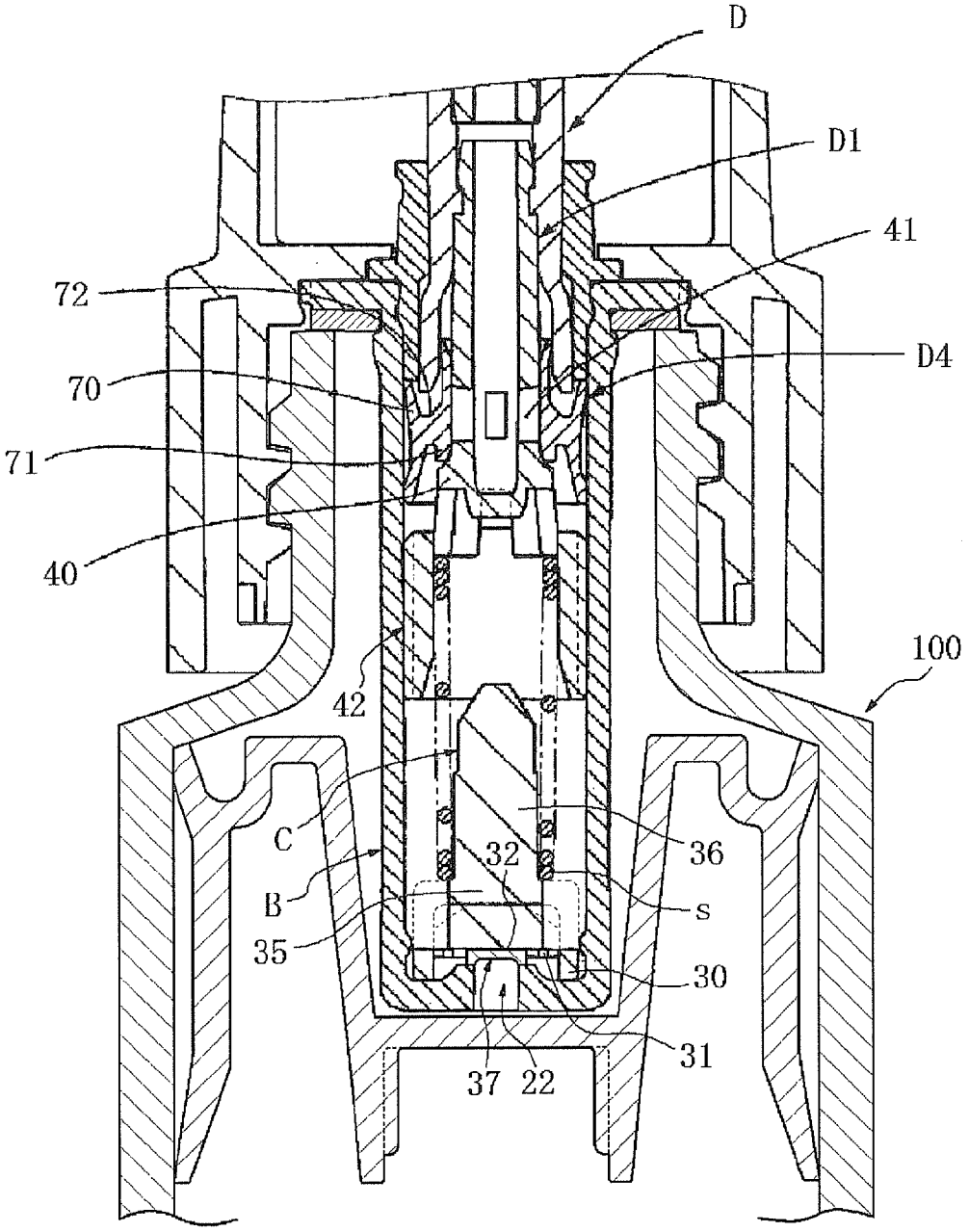
FIG. 4 is an enlarged section view of main parts of a pump according to Embodiment 3.

FIG. 4 shows a pump according to Embodiment 3. It should be noted that the same reference numerals are assigned to the same components as those used in Embodiments 1 and 2, and a description of such components is omitted. The following describes modified points only. The pump is characterized in that the cylinder B does not include the negative pressure release hole 26 and that ambient air is prevented from flowing into the container body 100 even after actuation of the pump. Because of the above characteristics, the pump can be combined with a container body in which a middle plate (bottom) is displaced upward with a decrease in container contents, as a High Viscosity Dispenser (HVD) (as shown in FIG. 4 in a state where the middle plate (bottom) has been displaced upward). In this case, a need for providing the pipe 25 at the end of the cylinder B is omitted since the container body 100 remains filled with the contents nearly to the top. The pump according to Embodiment 3 may also be suitably applied to a delamination bottle in which an outer container and an inner bag are layered such that the layers can be split from each other, or a double container in which an additional container that can be downsized with the decrease in the contents is disposed in the outer container. The pump is also characterized in that the pressure-contact valve body 32 has a thin walled portion 37 in a portion of the pressure-contact valve body 32 facing the suction valve hole 22 that is smaller in thickness than a portion of the pressure-contact valve body 32 abutted against the valve seat. Forming the thin walled portion 37 as above helps prevent molding defects (so-called sink marks) attributed to material shrinkage during molding, thereby offering a guarantee of a reliable abutment of the pressure-contact valve body 32 with the suction valve seat 22. As a result, sealing performance of the suction valve is improved, which leads to a stable discharge amount of the pump. The thin walled portion 37 may be applied to the pumps according to Embodiments 1 and 2 as well.

REFERENCE SIGNS LIST

1 Pump
A Mounting cap
10 Screw tube
11 Top plate
12 Guiding tube
13 Guiding recess
B Cylinder
20 Flange
21 Suction valve seat
22 Suction valve hole
23 Pipe fitting tube
24 Packing
25 Pipe
26 Negative pressure release hole
B1 Latch member
C Suction valve member
30 Fitting tube portion
31 Resilient piece
32 Pressure-contact valve body
33 Suction valve
34 Supporting plate
35 Supporting platform plate
36 Bar
37 Thin walled portion
D Actuation member
D1 Stem
40 Discharge valve seat
41 Discharge valve hole
42 Latch
D2 Connecting tubular member
50 Seal tube portion
51 Latch member
D3 Mounting tubular member
60 Mounting tube
61 Top plate
62 Slide tube
63 Guiding tubular portion
D4 Annular piston
70 Outer peripheral tubular portion
71 Inner peripheral tubular portion

72 Joining portion
73 Discharge valve
D5 Depression head (R: valve chamber)
80 Cylindrical portion
81 Discharge opening
82 Protrusion
D6 Opening-closing valve member
D7 Lever member
90 Vertical plate
91 Slant plate
s Coil spring
s1 Second coil spring
100 Container body
101 Trunk portion, 102 Shoulder portion, 103 Mouth-and-neck portion

The invention claimed is:

1. A pump to be vertically suspended and mounted in a container body for discharging liquid contained in the container body, comprising:

a cylinder including:

a suction valve at a bottom thereof; and an actuator member urged upward and depressible with respect to the cylinder, wherein:

the actuator member includes:

a stem having a bottomed tubular shape urged upward and depressible;

a depression head urged upward and relatively displaceable upward and downward with respect to the stem; and an annular piston provided around an outer circumference of the stem for relative upward and downward displacement with respect to the stem, the depression head comprises:

a valve chamber provided with a discharge opening at a tip thereof;

an opening-closing valve member disposed in the valve chamber in a manner such that the opening-closing valve member is urged toward the discharge opening; and a lever member connected at an upper end thereof to a rear end of the opening-closing valve member, and is configured such that, when depressed, the lever member of the depression head operates to open the discharge opening by displacing the opening-closing valve member and that a resistive force against the depression of the depression head with respect to the stem is smaller than a resistive force against the depression of the stem itself, the annular piston has a lower end forming a discharge valve in cooperation with a discharge valve seat protruding from the outer circumference of the stem and is configured to be pressed against the valve seat to close the discharge valve at a lowermost displacement position and displaced off the discharge valve seat to open the discharge valve at an uppermost displacement position, the annular piston has an H-shaped cross section formed by joining an outer peripheral tubular portion and an inner peripheral tubular portion with a joining portion, the outer peripheral tubular portion being fitted at upper and lower edges thereof to an inner periphery of the cylinder for a leak tight sliding contact with the cylinder and the inner peripheral tubular portion being fitted at an upper edge thereof to an inner periphery of a sealing tubular portion for a leak tight sliding contact with the sealing tubular portion, the sealing tubular portion being suspended around the outer circumference of the stem to form a double tube structure, and the discharge valve is formed by an lower edge of the inner peripheral tubular portion in cooperation with the discharge valve seat, and the annular piston is relatively displaced upward and downward with respect to the stem from a position where the lower edge of the inner peripheral tubular portion is pressed against the discharge valve seat to a position where an upper end surface of a connecting part is abutted against a lower end surface of the sealing tubular portion, and a stroke width from the position where the lower edge of the inner peripheral tubular portion of the annular piston is pressed against the discharge valve seat to the uppermost displacement position is selected so that back suction is caused due to a negative pressure state in the stem occurring until the discharge valve seat is closed by the annular piston during upward displacement of the stem.

2. The pump according to claim 1, wherein the stroke width is $1.5\times10^{-3}$ m or more.

3. The pump according to claim 1, wherein the suction valve comprises a pressure-contact valve in which a pressure-contact valve body is constantly pressed against a suction valve seat.

4. The pump according to claim 1, further comprising:

a first resilient member urging the stem; and a second resilient member urging the opening-closing valve member, wherein resilience of the second resilient member is selected to be smaller than resilience of the first resilient member.

5. The pump according to claim 2, wherein the suction valve comprises a pressure-contact valve in which a pressure-contact valve body is constantly pressed against a suction valve seat.

6. The pump according to claim 2, further comprising:

a first resilient member urging the stem; and a second resilient member urging the opening-closing valve member, wherein resilience of the second resilient member is selected to be smaller than resilience of the first resilient member.

7. The pump according to claim 3, further comprising:

a first resilient member urging the stem; and a second resilient member urging the opening-closing valve member, wherein resilience of the second resilient member is selected to be smaller than resilience of the first resilient member.

8. The pump according to claim 5, further comprising:

a first resilient member urging the stem; and a second resilient member urging the opening-closing valve member, wherein resilience of the second resilient member is selected to be smaller than resilience of the first resilient member.

* * * * *